US005752614A

United States Patent [19]

Nelson et al.

[11] Patent Number: 5,752,614

[45] Date of Patent: May 19, 1998

[54] EASY-OPENING CLOSURE FOR HERMETIC SEALING A RETORTABLE CONTAINER

[75] Inventors: Brian E. Nelson, Camden; James L. Lowry, Florence, both of S.C.

[73] Assignee: Sonoco Products Company, Hartsville, S.C.

[21] Appl. No.: 752,360

[22] Filed: Nov. 19, 1996

[51] Int. Cl.[6] ..... B65D 17/40

[52] U.S. Cl. ..... 220/276; 220/254; 220/270; 220/359; 229/123.1

[58] Field of Search ..... 220/254, 619, 220/626, 270, 276, 359, 257, 265, 266; 229/5.5, 123.1

[56] References Cited

U.S. PATENT DOCUMENTS

| | | | |
|---|---|---|---|
| 594,130 | 11/1897 | Burnett . | |
| 3,572,540 | 3/1971 | LaCroce | 220/254 |
| 3,628,689 | 12/1971 | Rogers | 229/5.5 X |
| 4,165,016 | 8/1979 | Moller | 220/359 X |
| 4,211,336 | 7/1980 | Helms . | |
| 4,253,584 | 3/1981 | Bloeck et al. . | |
| 4,360,121 | 11/1982 | Helms . | |
| 4,540,105 | 9/1985 | Wright . | |
| 4,544,080 | 10/1985 | Wright et al. . | |
| 4,637,543 | 1/1987 | Kücherer . | |
| 4,712,706 | 12/1987 | Nakata et al. . | |
| 4,735,339 | 4/1988 | Benge et al. . | |
| 4,801,041 | 1/1989 | Takata et al. . | |
| 4,856,708 | 8/1989 | Giasi . | |
| 4,858,780 | 8/1989 | Odaka et al. . | |
| 4,905,838 | 3/1990 | Suzuki et al. . | |
| 4,913,307 | 4/1990 | Takata et al. . | |
| 5,027,999 | 7/1991 | Kücherer . | |
| 5,054,642 | 10/1991 | Yoshida . | |
| 5,069,355 | 12/1991 | Matuszak . | |
| 5,083,675 | 1/1992 | Albanesi . | |
| 5,125,528 | 6/1992 | Heyn et al. . | |
| 5,246,134 | 9/1993 | Roth et al. . | |
| 5,328,045 | 7/1994 | Yoshida . | |
| 5,353,943 | 10/1994 | Hayward . | |
| 5,395,005 | 3/1995 | Yoshida . | |
| 5,439,132 | 8/1995 | Gorlich . | |

FOREIGN PATENT DOCUMENTS

| | | |
|---|---|---|
| 2 237 259 | 5/1991 | United Kingdom . |

*Primary Examiner*—Allan N. Shoap
*Assistant Examiner*—Robin A. Hylton
*Attorney, Agent, or Firm*—Bell Seltzer Intellectual Property Law Group Alston & Bird LLP

[57] ABSTRACT

An easy-opening closure is provided for hermetically sealing of an open end of a retortable container. The closure includes a metal end ring having a deformable outside peripheral area for being double seamed to the open end of the retortable container and having an inside area defining a large circular central opening to allow access therethrough to the interior of the container. An outside peripheral area of a membrane ring overlaps and is attached to the inside area of the metal end ring by a bond having predetermined shear and tensile force strengths. An inside peripheral area of the membrane ring extends inwardly into the circular central opening. A membrane patch is provided to cover the central opening and has an outer peripheral area overlapping and attached to an upper side of the membrane ring by a bond having predetermined shear and tensile force strengths. The predetermined shear and tensile force strengths of the bonds between the closure components are designed to have sufficient strength to withstand shear and/or tensile forces created during retort processing of the container, while allowing easy-opening of the container by peeling of closure components.

18 Claims, 3 Drawing Sheets

EASY-OPENING CLOSURE FOR HERMETIC SEALING A RETORTABLE CONTAINER

FIELD OF THE INVENTION

This invention relates to an easy-opening closure for hermetic sealing of an open end of a retortable container.

BACKGROUND OF THE INVENTION

Containers for packaging of food products which are subjected to retort processing, i.e. pressure cooking for food preservation, have become more and more in demand in the United States and elsewhere. These containers desirably have closures which hermetically seal the retortable container and maintain such hermetic seal during pasteurization and/or retort processing which subjects the contents of the container to temperatures above 212° F. and up to 250° F. under pressures of 15 to 30 psi. These temperatures and pressures cause shear and/or tensile forces to be exerted on the closure which tend to open up the closure unless very strong seals are provided between closure components to resist these forces. When such sufficiently strong seals are provided between the closure components, easy-opening of the container by the consumer becomes a problem.

Accordingly, it is highly desirable to provide a closure for a retortable container which will close the container and hermetically seal the container and which has bonds between closure components which are strong enough to withstand forces produced by internal pressures and temperatures created within the container during retort processing, yet allow for easy-opening of the container by the consumer through peeling of closure components. Heretofore, a closure construction has not been provided which will provide these desirable characteristics.

OBJECT AND SUMMARY OF THE INVENTION

It is an object of this invention to provide a closure for hermetic sealing of an open end of a retortable container which is constructed to resist forces created within the container during retort processing, yet provide for easy-opening of the container by the consumer.

By this invention it has been found that the above object may be accomplished by providing an easy-opening closure having the following construction.

A metal end ring has a deformable outside peripheral area which is adapted to be double seamed to the open end of the retortable container and has an inside area defining a large circular central opening to allow access therethrough to the interior of the container. A membrane ring has an outside peripheral area overlapping and attached to the inside area of the metal end ring by a bond having predetermined shear and tensile force strengths and having an inside peripheral area extending inwardly into the circular central opening. A membrane patch of sufficient size to cover the central opening has an outer peripheral area overlapping and attached to an upper side of the membrane ring by a bond having predetermined shear and tensile force strengths. The predetermined shear and tensile force strengths of the bonds are sufficient to withstand shear and/or tensile forces created during retort processing of the container, while allowing easy-opening of the container by peeling of closure components.

In one preferred embodiment of an easy-opening closure constructed in accordance with this invention, the outside peripheral area of the membrane ring overlaps and is attached to an underside of the inside area of the metal end ring by a bond positioned to be placed into shear during retort processing of the container and which has a predetermined shear strength sufficient to reduce the shear forces exerted during retort processing. The membrane patch is attached to the upper side of the inside peripheral area of the membrane ring by a bond positioned to be placed into shear during retort processing of the container and which has a predetermined shear force strength sufficient to resist the shear forces exerted during retort processing and which has a predetermined tensile force strength which allows easy-opening of the container by peeling of the membrane patch from the membrane ring.

In another preferred embodiment of an easy-opening closure constructed in accordance with this invention, the outside peripheral area of the membrane ring overlaps and is attached to an overside surface of the inside area of the metal end ring by a bond positioned to be placed into tensile during retort processing of the container and which has a predetermined tensile strength sufficiently strong to withstand the tensile forces created during retort processing. The outer peripheral area of the membrane patch overlaps and is attached to an upper side of the inside and outside peripheral areas of the membrane ring by a bond positioned to be placed into shear during retort processing of the container and which has a predetermined shear force strength sufficiently strong to withstand the shear forces created during retort processing and which has a tensile force strength which allows easy-opening of the container by peeling of the membrane patch from the membrane ring.

In accordance with a third preferred embodiment of this invention, the outside peripheral area of the membrane ring overlaps and is attached to an overside surface of the inside area of the metal end ring by a bond which is unaffected during retort processing of the container and which has a predetermined tensile strength which allows easy-opening of the container by peeling of the membrane ring from the metal end ring. The inside peripheral area of the membrane ring which extends inwardly into the circular central opening is unattached to the inside area of the metal end ring. The outer peripheral area of the membrane patch overlaps and is attached to an upper side area of the outer peripheral area only of the membrane ring by a bond positioned to be placed into tensile and shear during retort processing of the container and which has a predetermined shear force strength and a predetermined tensile force strength sufficiently strong to withstand the shear forces and the tensile forces created during retort processing. The membrane patch is unattached to the inside peripheral area of the membrane ring so that forces created during retort processing will position the inside peripheral area of the membrane ring against the metal end ring to protect the bond between the metal end ring and the membrane ring from being placed into tensile or shear.

BRIEF DESCRIPTION OF THE DRAWINGS

Some of the objects and advantages of this invention having been set forth above, other objects and advantages will appear in connection with the detailed description of preferred embodiments of this invention when taken in conjunction with the accompanying drawings, in which:

FIG. 4 is a partial sectional view in elevation of a second preferred embodiment of an easy-opening closure double seamed onto a retortable container and containing food products or the like;

DETAILED DESCRIPTION OF PREFERRED EMBODIMENTS OF THE INVENTION

Figure 1:
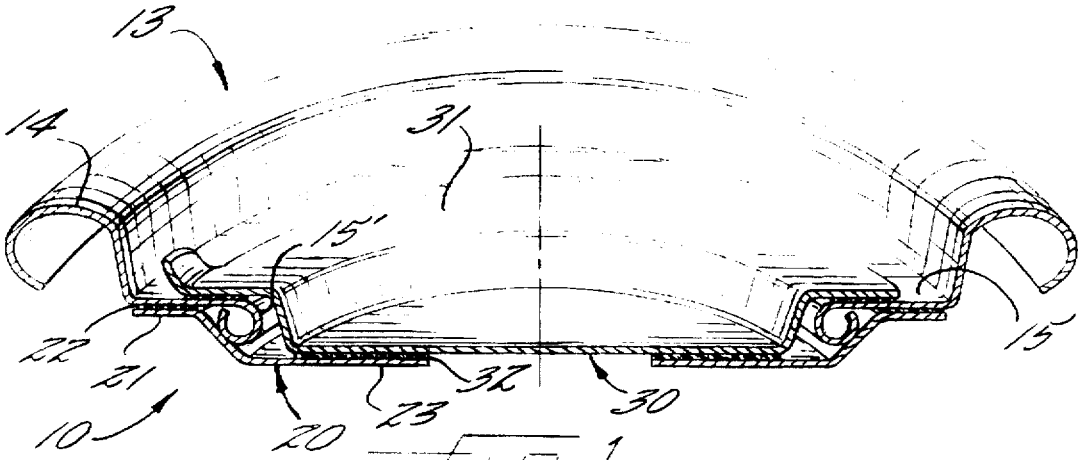
FIG. 1 is a sectional perspective view of approximately one-half of a circular easy-opening container closure constructed in accordance with a first preferred embodiment of this invention.

Referring now to the drawings, there are three preferred embodiments of an easy-opening closure, generally indicated at 10, for hermetically sealing an open end of a retortable container 11 (as illustrated in FIGS. 1–3, 4–6 and 7–8, respectively).

All of these embodiments of an easy-opening closure 10 include a metal end ring 13 having a deformable outside peripheral area 14 adapted to be double seamed to an open end of the retortable container 11 (as shown in FIGS. 2–8) and an inside area 15 defining a large circular central opening to allow access therethrough to the interior of the container 11.

The inside area 15 of the metal end ring 13 of the closure 10 may preferably include a rolled edge 15' to protect the hand of a user when accessing the interior of the container. All of the embodiments of an easy-opening closure 10 further include a membrane ring 20 having an outside peripheral area 21 overlapping and attached to the inside area 15 of the metal end ring 13 by a bond 22 having predetermined shear and tensile force strengths, and having an inside peripheral area 23 extending inwardly into the circular central opening formed by the metal end ring 13.

All of the embodiments of an easy-opening closure 10 further include a membrane patch 30 of sufficient size to cover the central opening and having an outer peripheral area 31 overlapping and attached to an upper side of the membrane ring 20 by a bond 32 having predetermined shear and tensile force strengths. In all of the embodiments of easy-opening closures 10, the outermost portion of outer peripheral area 31 of the membrane patch 30 is attached to the upper side of the inside area 15 of the metal end ring 13 by a bond 35 which is unaffected during retort processing of the container 11 and which has a predetermined tensile force strength, preferably less than 5 psi, which allows peeling of the membrane patch 30 from the metal end ring 13 during easy-opening of the container 11. The predetermined shear and tensile force strengths of the bonds 22, 32 are sufficient to withstand shear and/or tensile forces created during retort processing of the container 11, while allowing easy-opening of the container by peeling of closure components, as more fully described below.

Figure 2:
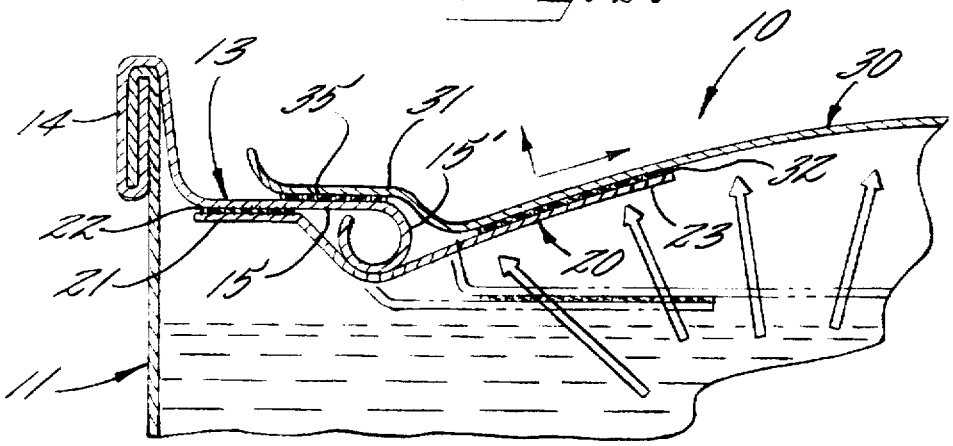
FIG. 2 is a partial sectional view in elevation of the closure of FIG. 1 shown double seamed onto the end of a retortable container containing food products or the like and which illustrates the forces produced during retort processing of the container.
Figure 3:
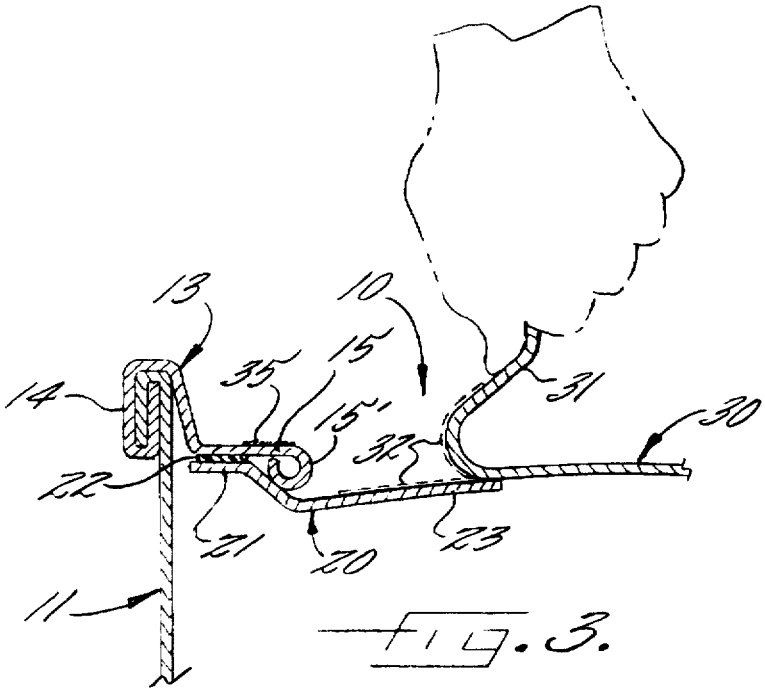
FIG. 3 is a partial perspective view of the closure and container of FIG. 2 and diagrammatically illustrating easy-opening of the container by peeling of closure components.

One of the preferred embodiments of the closure 10 of this invention (as illustrated in FIGS. 1–3) has the outside peripheral area 21 of the membrane ring 20 attached to an underside of the inside area 15 of the metal end ring 13 by the bond 22 positioned to be placed into shear during retort processing of the container 11 (as shown in FIG. 2) and having a predetermined shear force strength, preferably greater than 15 psi, sufficient to resist the shear forces exerted during such retort processing. In this embodiment of FIGS. 1–3, the membrane patch 30 is attached to the upper side of the inside peripheral area 23 of the membrane ring 20 by the bond 32 positioned to be placed into shear during retort processing of the container and which has a predetermined shear force strength, preferably more than 15 psi, sufficient to resist shear force exerted during retort processing and which has a predetermined tensile force strength, preferably less than 5 psi, which allows easy-opening of the container 11 by peeling of the membrane patch 30 from the membrane ring 20 of the closure 10 (as shown in FIG. 3).

Figure 4:
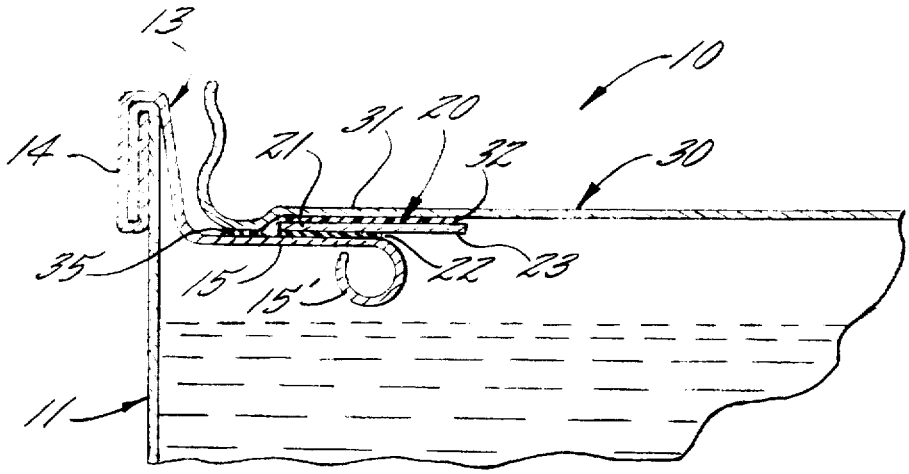
Figure 5:
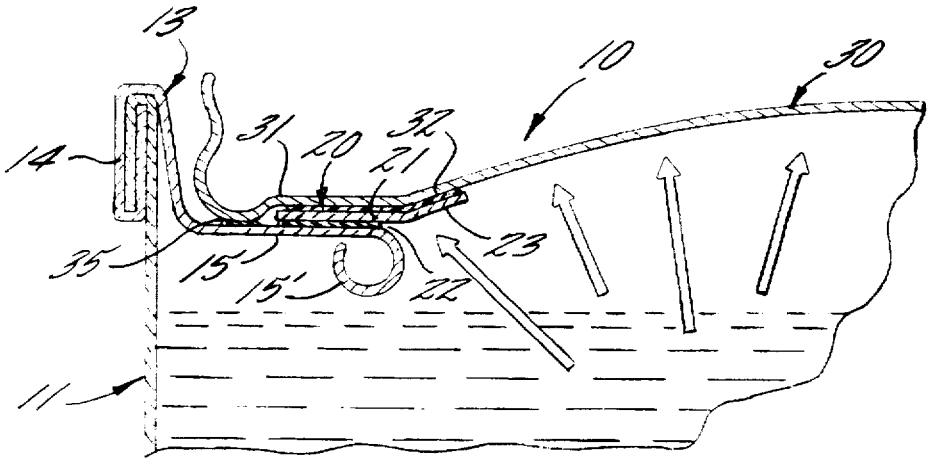
FIG. 5 is a view, like FIG. 4, and further illustrating forces created within the container on the closure during retort processing.
Figure 6:
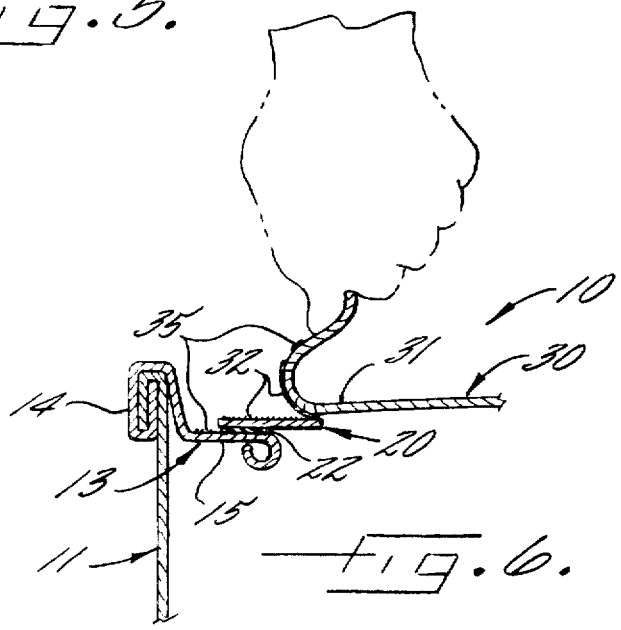
FIG. 6 is a partial sectional view of the closure and container of FIG. 4 and diagrammatically illustrating easy-opening of the closure by peeling of closure components.

Another preferred embodiment of the closure 10 of this invention (as illustrated in FIGS. 4–6) has the outside peripheral area 21 of the membrane ring 20 overlapping and attached to an overside surface of the inside area 15 of the metal end ring 13 by the bond 22 positioned to be placed into tensile during retort processing of the container 11 (as shown in FIG. 5) and having a predetermined tensile force strength, preferably greater than 15 psi, sufficiently strong to withstand the tensile forces created during retort processing. The outer peripheral area 31 of the membrane patch 30 overlaps and is attached to an upper side of the outside and inside peripheral areas 21, 23 of the membrane ring 20 by the bond 22 positioned to be placed into shear during retort processing of the container 11 and which has a predetermined shear force strength, preferably more than 15 psi, sufficiently strong to withstand the shear forces created during retort processing and which has a tensile force strength, preferably less than 5 psi, which allows easy-opening of the container 11 by peeling of the membrane patch 30 from the membrane ring 20 of the closure 10 (as shown in FIG. 6).

Figure 7:
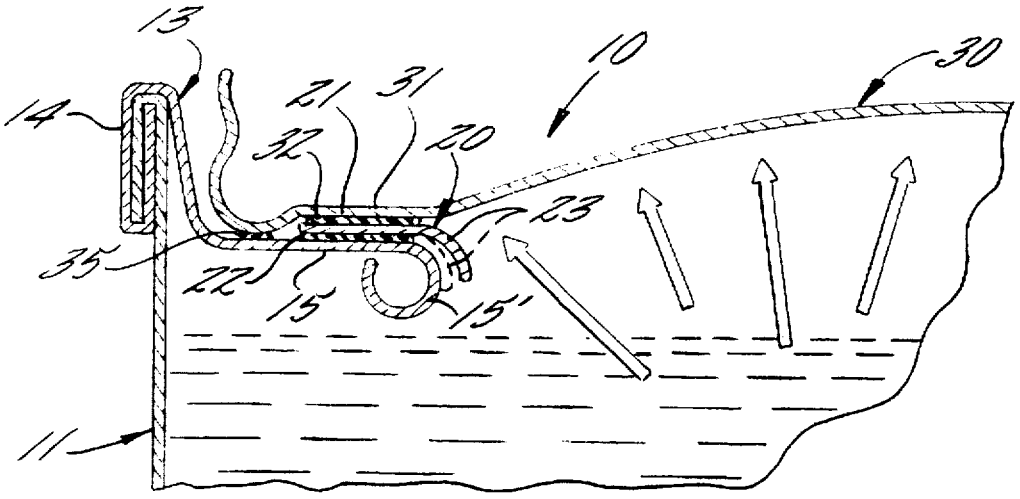
FIG. 7 is a partial sectional view in elevation of a third preferred embodiment of an easy-opening closure double seamed onto a retortable container containing food products or the like and illustrating the forces created within the container on the closure during retort processing.
Figure 8:
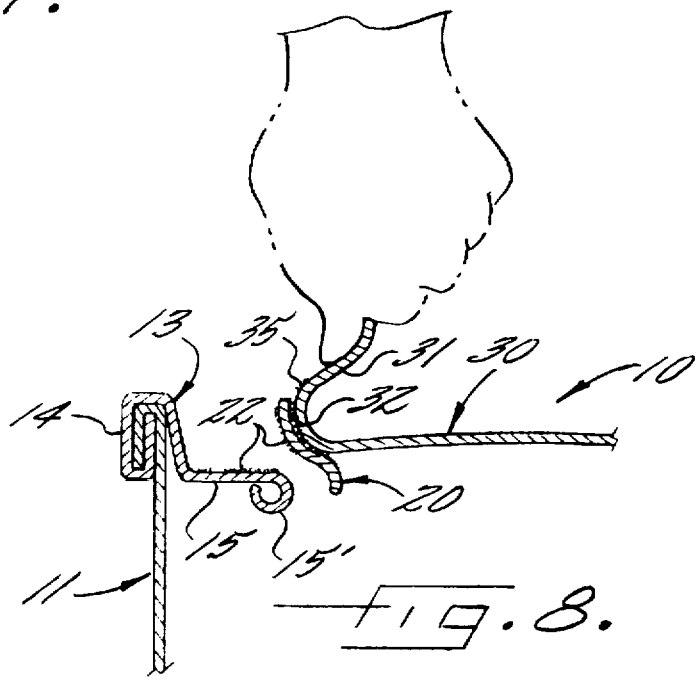
FIG. 8 is a partial sectional view of the closure on the container of FIG. 7 and diagrammatically illustrating easy-opening of the closure by peeling of components.

In a third preferred embodiment of the closure 10 of this invention (as illustrated in FIGS. 7 and 8) the outside peripheral area 21 of the membrane ring 20 overlaps and is attached to an overside surface of the inside area 15 of the metal end ring 13 by the bond 22 which is unaffected during retort processing of the container and which has a predetermined tensile strength, preferably less than 5 psi, which allows easy-opening of the container 11 by peeling of the membrane ring 20 from the metal end ring 13 (as shown in FIG. 8). The inside peripheral area 23 of the membrane ring 20 which extends inwardly into the circular central opening is unattached to the inside area 15 of the metal end ring 13. The outer peripheral area 31 of the membrane patch 30 overlaps and is attached to an upper side of the outer peripheral area 21 only of the membrane ring 20 by the bond 32 positioned to be placed into tensile and shear during retort processing of the container 11 (as shown in FIG. 7) and which has a combined predetermined shear force strength and a predetermined tensile force strength, preferably greater than 15 psi, sufficient strong to withstand the shear forces and tensile forces created during retort processing. The membrane patch 30 is unattached to the inside peripheral area 23 of the membrane ring 20 so that forces created during retort processing will position the inside peripheral area of the membrane ring against the metal end ring (as shown in dotted lines in FIG. 7) to protect the bond 22 between the metal end ring 13 and the membrane ring 20 from being placed into tensile or shear.

In all of the above described embodiments of the closure 10 constructed in accordance with this invention, the metal end ring 13 may be constructed of any suitable metal material including aluminum and steel. Steel is preferable and can be produced from any number of grades which may or may not have a tin plate. The metal end ring can be either coated or laminated with a heat-sealable material. The heat-sealable material is preferably in the form of a polymer dispersion in a "can coating" (well known to those with ordinary skill in the art) that is applied in a standard can coating process or formed as a lamination of a polymer film to the metal. The polymer dispersion or film laminate can be any material that can withstand the retort environment and it has been found that polypropylene is preferred. The membrane ring 20 utilized in all of the above described embodiments of the easy-opening closure 10 preferably also uses a layer or outside layers of heat-sealable material in the form of polypropylene. A multi-layer structure is used when additional strength is needed in the membrane ring.

The membrane patch 30 for all of the above described embodiments of the easy-opening closure 10 preferably utilizes a polypropylene heat seal layer at least on the bottom thereof and may also include a foil backbone layer. Often an additional layer is provided on top of the foil layer to add additional strength to the membrane patch 30. The top layer can be a polyester laminate. The polypropylene heat seal layer can be cast polypropylene, blown polypropylene or may in the form of a co-extrusion. With the use of a polypropylene bottom layer on the membrane patch, polypropylene upper and lower layers on the membrane ring 20 and polypropylene upper and lower layers on the metal end ring 13, all of the bonds 22, 32 and 35 are heat seal bonds. These heat seal bonds can vary between a fusion bond which gives the maximum strength in both shear and tensile, to a heat seal bond which provides sufficient strength in shear to resist the retort forces while being sufficiently weak in tensile to allow peeling of the bond.

Accordingly, it may be seen that this invention has provided several embodiments of an easy-opening closure 10 for hermetically sealing a retortable container 11 which is constructed to resist forces created within the container 11 during retort processing, yet provides for easy-opening of the container 11 by peeling of closure components.

In the drawings and the specification, there has been set forth preferred embodiments of the invention and, although specific terms are employed, the terms are used in a generic and descriptive sense only and not for purpose of limitation, the scope of the invention being set forth in the following claims.

What is claimed is:

1. An easy-opening closure for hermetic sealing of an open end of a retortable container, said closure comprising:

a metal end ring having a deformable outside peripheral area adapted to be doubled seamed to the open end of the retortable container and an inside area defining a large circular central opening to allow access therethrough to the interior of the container;

a membrane ring having an outside peripheral area overlapping and attached to said inside area of said metal end ring by a bond having predetermined shear and tensile force strengths and having an inside peripheral area extending inwardly into said circular central opening;

a membrane patch of sufficient size to cover said central opening and having an outer peripheral area overlapping and attached to an upper side of said membrane ring by a bond having predetermined shear and tensile force strengths; and said predetermined shear and tensile strength of said bonds being sufficient to withstand shear and/or tensile forces created during retort processing of the container, while allowing easy-opening of the container by peeling of closure components.

2. An easy-opening closure, as set forth in claim 1, wherein said outer peripheral area of said membrane patch also overlaps and is attached to an upper side of said inside area of said metal end ring by a bond which is unaffected during retort processing of the container and having a predetermined tensile force strength which allows peeling of said membrane patch from said metal end ring.

3. An easy-opening closure for hermetic sealing of an open end of a retortable container, said closure comprising:

a metal end ring having a deformable outside peripheral area adapted to be double seamed to the open end of the retortable container and an inside area defining a large circular central opening to allow access therethrough to the interior of the container;

a membrane ring having an outside peripheral area overlapping and attached to an underside of said inside area of said metal end ring by a bond positioned to be placed into shear during retort processing of the container and having predetermined shear force strength sufficient to resist the shear forces exerted during retort processing and having an inside peripheral area extending inwardly into said circular central opening; and a membrane patch of sufficient size to cover said central opening and having an outer peripheral area overlapping and attached to an upper side of said inside peripheral area of said membrane ring by a bond positioned to be placed into shear during retort processing of the container and having a predetermined shear force strength sufficient to resist the shear forces exerted during retort processing and having a predetermined tensile force strength which allows easy-opening of the container by peeling of said membrane patch from said membrane ring.

4. An easy-open closure, as ;et forth in claim 3, wherein said outer peripheral area of said membrane patch also overlaps and is attached to an upper side of said inside area of said metal end ring by a bond which is unaffected during retort processing of the container and having a predetermined tensile force strength which allows peeling of said membrane patch from said metal end ring.

5. An easy-opening closure, as set forth in claim 3 or 4, in which said bond between said membrane ring and said metal end ring has a shear strength of greater than 15 psi, and said bond between said membrane patch and said membrane ring has a shear strength of greater than 15 psi and a tensile strength of less than 5 psi.

6. An easy-opening closure, as set forth in claim 4, in which said bond between said membrane ring and said metal end ring has a shear strength of greater than 15 psi, said bond between said membrane patch and said membrane ring has a shear strength of greater than 15 psi and a tensile strength of less than 5 psi, and said bond between said membrane patch and said metal end ring has a tensile strength of less than 5 psi.

7. An easy-opening closure for hermetic sealing of an open end of a retortable container, said closure comprising:

a metal end ring having a deformable outside peripheral area adapted to be double seamed to the open end of the retortable container and an inside area defining a circular central opening to allow access therethrough to the interior of the container;

a membrane ring having an outside peripheral area overlapping and attached to an overside surface of said inside area of said metal end ring by a bond positioned to be placed into tensile during retort processing of the container and having a predetermined tensile strength sufficiently strong to withstand the tensile forces created during retort processing and having an inside peripheral area extending inwardly into said circular central opening; and a membrane patch of sufficient size to cover said central opening and having an outer peripheral area overlapping and attached to an upper side of said inside and outside peripheral areas of said membrane ring by a bond positioned to be placed into shear during retort processing of the container and having a predetermined shear force strength sufficiently strong to withstand the shear forces created during retort processing and having a predetermined tensile force strength which allows easy-opening of the container by peeling of said membrane patch from said membrane ring.

8. An easy-opening closure, as set forth in claim 7, wherein said outer peripheral area of said membrane patch also overlaps and is attached to an upper side of said inside area of said metal end ring by a bond which is unaffected during retort processing of the container and having a predetermined tensile force strength which allows peeling of said membrane patch from said metal end ring.

9. An easy-opening closure, as set forth in claim 7 or 8, in which said bond between said membrane ring and said metal end ring has a tensile strength of greater than 15 psi, and said bond between said membrane patch and said membrane ring has a shear strength of greater than 15 psi and a tensile strength of less than 5 psi.

10. An easy-opening closure, as set forth in claim 8, in which said bond between said membrane ring and said metal end ring has a tensile strength of greater than 15 psi, said bond between said membrane patch and said membrane ring has a shear strength of greater than 15 psi and a tensile strength of less than 5 psi, and said bond between said membrane patch and said metal end ring has a tensile strength of less than 5 psi.

11. An easy-opening closure for hermetic sealing of an open end of a retortable container, said closure comprising:

a metal end ring having a deformable outside peripheral area adapted to be double seamed to the open end of the retortable container and an inside area defining a circular central opening to allow access therethrough to the interior of the container;

a membrane ring having an outside peripheral area overlapping and attached to an overside surface of said inside area of said metal end ring by a bond which is unaffected during retort processing of the container and having a predetermined tensile strength which allows easy-opening of the container by peeling of said membrane ring from said metal end ring, said membrane ring having an inside peripheral area extending inwardly into said circular central opening and being unattached to said inside area of said metal end ring; and a membrane patch of sufficient size to cover said central opening and having an outer peripheral area overlapping an upper side of said membrane ring and being attached to said outside peripheral area only of said membrane ring by a bond positioned to be placed into tensile and shear during retort processing of the container and having a predetermined shear force strength and predetermined tensile force strength sufficiently strong to withstand the shear forces and the tensile forces created during retort processing, said membrane patch being unattached to said inside peripheral area of said membrane ring so that forces created during retort processing will position said inside peripheral area of said membrane ring against said metal end ring to protect said bond between said metal end ring and said membrane ring from being placed into tensile or shear.

12. An easy-opening closure, as set forth in claim 11, wherein said outer peripheral area of said membrane patch also overlaps and is attached to an upper side of said inside area of said metal end ring by a bond which is unaffected during retort processing of the container and having a predetermined tensile force strength which allows peeling of said membrane patch from said metal end ring.

13. An easy-opening closure, as set forth in claim 11 or 12, in which said bond between said membrane ring and said metal end ring has a tensile strength of less than 5 psi, and said bond between said membrane patch and said membrane ring has a shear strength and a tensile strength of greater than 15 psi.

14. An easy-opening closure, as set forth in claim 12, in which said bond between said membrane ring and said metal end ring has a tensile strength of less than 5 psi, and said bond between said membrane patch and said membrane ring has a shear strength and a tensile strength of greater than 15 psi, and said bond between said membrane patch and said metal end ring has a tensile strength of less than 5 psi.

15. An easy-opening closure, as set forth in claim 1, 2, 3, 4, 7, 8, 11 or 12 in which said metal end ring comprises steel having polypropylene heat-sealable surfaces, said membrane ring includes polypropylene heat-sealable surfaces, said membrane patch comprises a foil layer having a polypropylene heat-sealable bottom surface, and said bonds comprising heat-sealed bonds.

16. An easy-opening closure for hermetic sealing of an open end of a retortable container, said closure comprising:

a metal end ring comprising steel having polypropylene heat-sealable surfaces and having a deformable outside peripheral area adapted to be double seamed to the open end of the retortable container and having an inside area with a rolled edge defining a large circular central opening to allow access therethrough to the interior of the container;

a membrane ring including polypropylene heat-sealable surfaces and having an outside peripheral area overlapping and attached to the underside of said inside area of said metal end ring member by a heat-sealed bond positioned to be placed in shear during retort processing of the container and having predetermined shear strength of greater than 15 psi sufficient to resist shear forces exerted during retort processing and having an inside peripheral area extending inwardly into said circular central opening; and a membrane patch comprising a foil layer having a polypropylene heat-sealable bottom surface and being of sufficient size to cover said central opening and having an outer peripheral area overlapping and attached to an upper side of said inside peripheral area of said membrane ring by a heat-sealed bond positioned to be placed into shear during retort processing of the container and having a predetermined shear force strength of greater than 15 psi sufficient to resist the shear forces exerted during retort processing and having a predetermined tensile force strength of less than 5 psi which allows easy-opening of the container by peeling of said membrane patch from said membrane ring, said outer peripheral area of said membrane patch also overlapping and attached to an upper side of said inside of said metal end ring by a heat-sealed bond which is unaffected during retort processing of the container and having a predetermined tensile force strength of less than 5 psi which allows peeling of said membrane patch from said metal end ring.

17. An easy-opening closure for hermetic sealing of an open end of a retortable container, said closure comprising:

a metal end ring comprising steel having polypropylene heat-sealable surfaces and having a deformable outside peripheral area adapted to be double seamed to the open end of the retortable container and an inside area with a rolled edge defining a circular central opening to allow access therethrough to the interior of the container;

a membrane ring including polypropylene heat-sealable surfaces and having an outside peripheral area overlapping and attached to an overside surface of said inside area of said metal end ring member by a heat-sealed fusion bond positioned to be placed into tensile during retort processing of the container and having a predetermined tensile strength of greater than 15 psi sufficiently strong to withstand the tensile forces created during retort processing and having an inside peripheral area extending inwardly into said circular central opening; and a membrane patch comprising a foil layer having a polypropylene heat-sealable bottom surface and being of sufficient size to cover said central opening and having an outer peripheral area overlapping and attached to an upper side of said inside and outside peripheral areas of said membrane ring by a heat-sealed bond positioned to be placed into shear during retort processing of the container and having a predetermined shear force strength of greater than 15 psi sufficient to withstand the shear forces created during retort processing and having a predetermined tensile force strength of less than 5 psi which allows easy-opening of the container by peeling of said membrane patch from said membrane ring, said outer peripheral area of said membrane patch also overlapping and attached to an upper side of said inside area of said metal end ring by a heat-sealed bond which is unaffected during retort processing of the container and having a predetermined tensile force strength of less than 5 psi which allows peeling of said membrane patch from said metal end ring.

18. An easy-opening closure for hermetic sealing of an open end of a retortable container, said closure comprising:

a metal end ring comprising steel having polypropylene heat-sealable surfaces and having a deformable outside peripheral area adapted to be double seamed to the open end of the retortable container and an inside area with a rolled edge defining a circular central opening to allow access therethrough to the interior of the container;

a membrane ring including polypropylene heat-sealable surfaces and having an outer peripheral area overlapping and attached to an overside surface of said inside area of said metal ring by a heat-sealed bond which is unaffected during retort processing of the container and having a predetermined tensile strength of less than 5 psi which allows easy-opening of the container by peeling of said membrane ring from said metal end ring, said membrane ring having an inside peripheral area extending inwardly into said circular central opening and being unattached to said inside area of said metal end ring; and a membrane patch comprising a foil layer having a polypropylene heat-sealable bottom surface and being of sufficient size to cover said central opening and having an outer peripheral area overlapping an upper side of said membrane ring and being attached to said outside peripheral area only of said membrane ring by a heat-sealed fusion bond positioned to be placed into tensile and shear during retort processing of the container and having predetermined shear force strength and predetermined tensile force strength of greater than 15 psi sufficiently strong to withstand the shear forces and the tensile forces created during retort processing, said membrane patch being unattached to said inside peripheral area of said membrane ring so that forces created during retort processing will position said inside peripheral area of said membrane ring against said metal end ring to protect said heat-sealed bond between said metal end ring and said membrane ring from being placed into tensile or shear, said outer peripheral area of said membrane patch also overlapping and attached to an upper side of said inside area of said metal end ring by a heat-sealed bond which is unaffected during retort processing of the container and having a predetermined tensile force strength of less than 5 psi which allows peeling of said membrane patch from said metal end ring.

* * * * *